US005351851A

United States Patent [19]

Powell

[11] Patent Number: 5,351,851

[45] Date of Patent: Oct. 4, 1994

[54] CONTAINER WITH INSERT AREA

[75] Inventor: David A. Powell, Coon Rapids, Minn.

[73] Assignee: Kablooe Products, Inc., Blaine, Minn.

[21] Appl. No.: 206,263

[22] Filed: Mar. 7, 1994

Related U.S. Application Data

[63] Continuation of Ser. No. 68,421, May 28, 1993, abandoned.

[51] Int. Cl.[5] ..... B65D 65/16

[52] U.S. Cl. ..... 220/503; 215/6; 220/505; 220/524; 220/662; 229/87.06; 229/89

[58] Field of Search ..... 206/217, 216, 459.5; 40/306, 310; 229/87.06, 87.01, 89; 383/106; 220/23.83, 23.86, 23.4, 662, 403, 400, 503, 524, 505, 523, 555; 215/6, 10

[56] References Cited

U.S. PATENT DOCUMENTS

| | | | |
|---|---|---|---|
| 217,190 | 7/1879 | Osborne et al. | 229/89 |
| 625,138 | 5/1899 | Boyd | 220/524 |
| 1,955,893 | 4/1934 | Scott | 229/87.01 |
| 2,008,167 | 7/1935 | Bergstein | 229/87.06 |
| 2,102,128 | 12/1937 | Replogle et al. | 229/89 |
| 2,143,156 | 1/1939 | Kennedy | 229/89 |
| 2,173,686 | 9/1939 | Hamje | 229/87.01 |
| 2,518,711 | 8/1950 | Mulford | 383/106 |
| 3,235,112 | 2/1966 | Fillwalk et al. | 229/89 |
| 3,391,824 | 7/1968 | Wiseman . | |
| 3,658,204 | 4/1972 | Bottger | 220/23.86 |
| 4,195,728 | 4/1980 | Cardamone | 220/23.86 |
| 4,235,343 | 11/1980 | Thompson | 215/10 |
| 4,571,740 | 2/1986 | Kirby et al. | 206/216 |
| 4,802,295 | 2/1989 | Darr | 40/310 |
| 4,893,722 | 1/1990 | Jones | 220/503 |
| 5,029,700 | 7/1991 | Chen | 206/217 |
| 5,065,875 | 11/1991 | Balavich | 215/10 |

*Primary Examiner*—S. Castellano
*Attorney, Agent, or Firm*—James R. Cwayna

[57] ABSTRACT

Containers including bottles of either cylindrical, rectangular or other geometric or sculptural form having at least one selected area of a sidewall thereof providing a depression or indentation to receive at least one article; solid, liquid, granular or other material therein. After placement of such article in this area, the article may be retained therein through adhesives or other adherents or the area may simply be overlayed with a covering film to retain the article. The covering film may simply cover this particular area and preferably would be clear over the area to allow viewing of the article or may include labelling materials which substantially surround the container with a clear area maintained over the indented or depressed area and similarly, the container may be silk screened or otherwise decorated with clear covering film being limited to the depressed or indented area.

4 Claims, 3 Drawing Sheets

FIG. 6
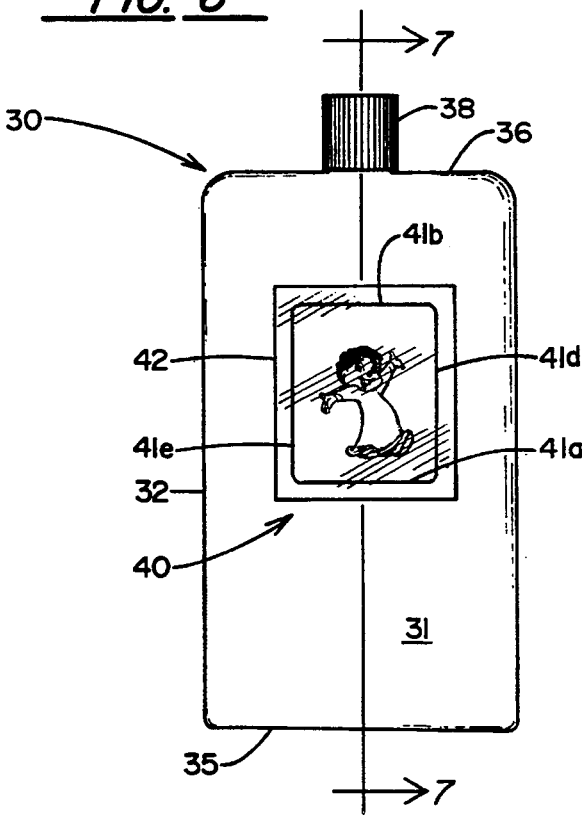
FIG. 7
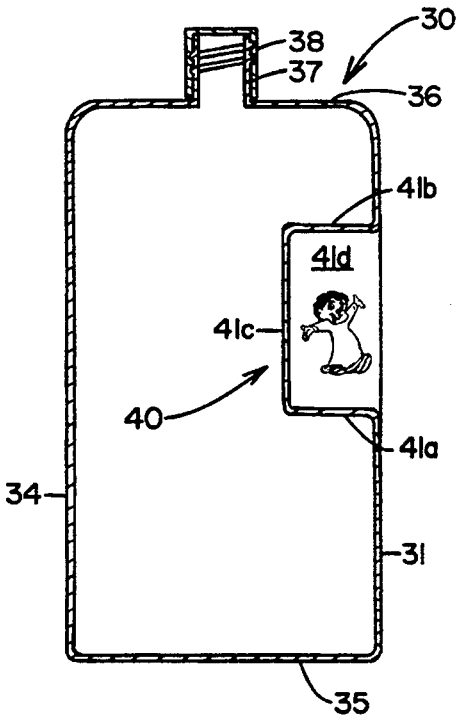
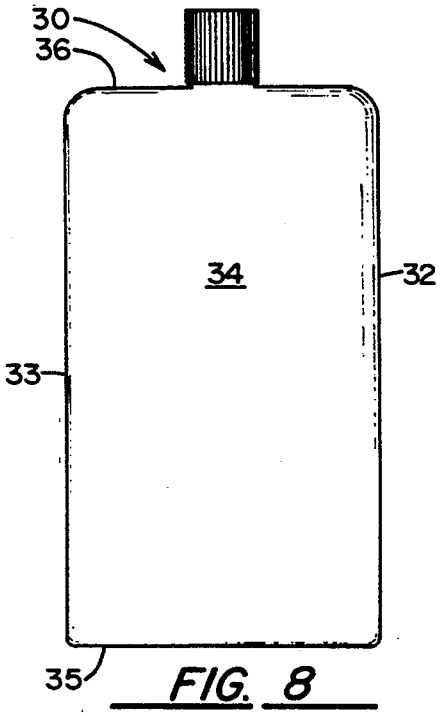
FIG. 8
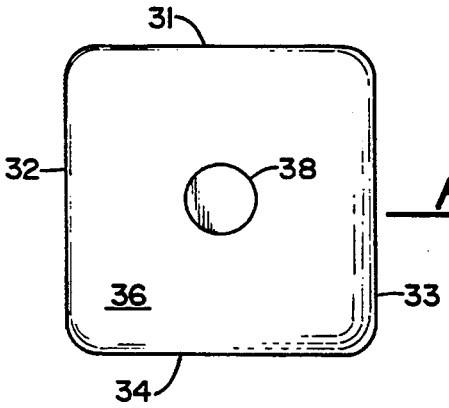
FIG. 9
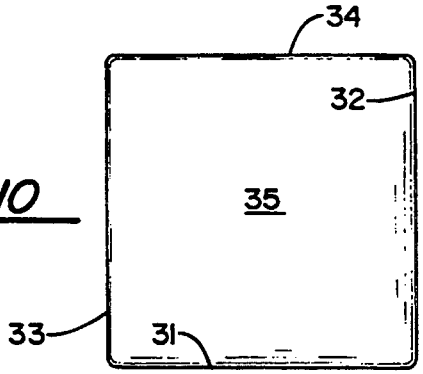
FIG. 10

FIG. 11
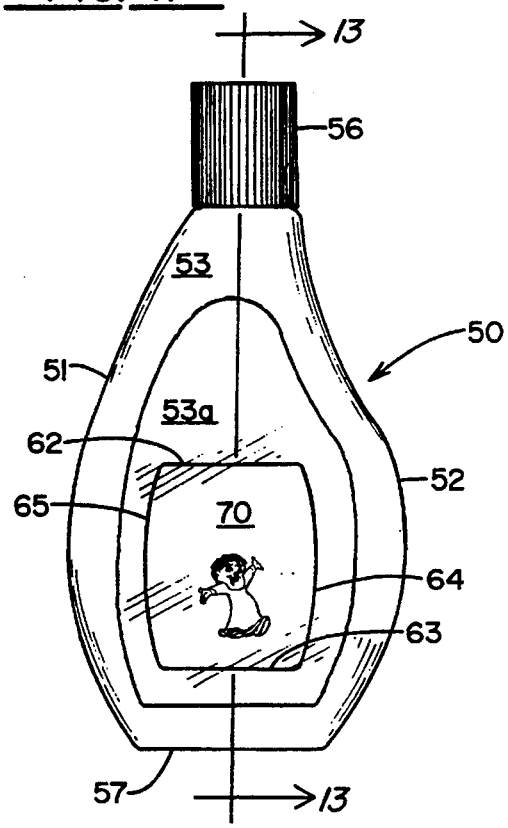
FIG. 13
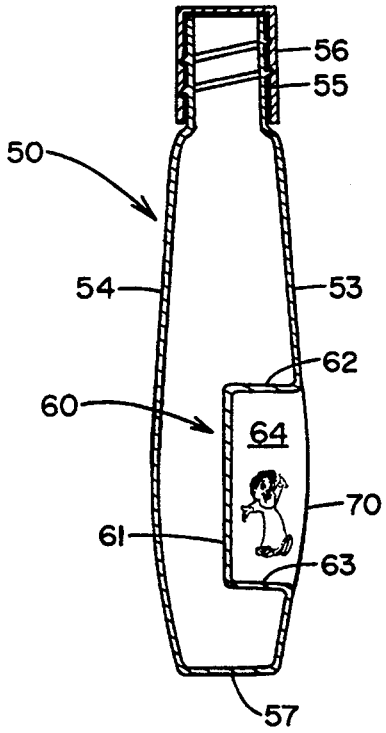
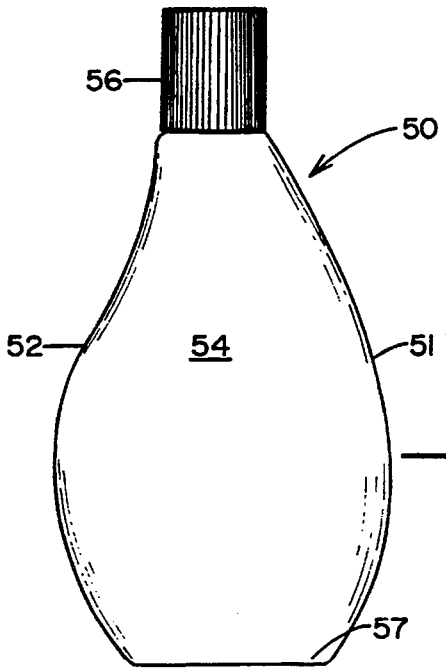
FIG. 12
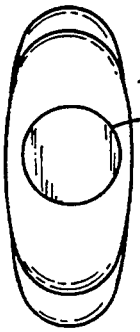
FIG. 14
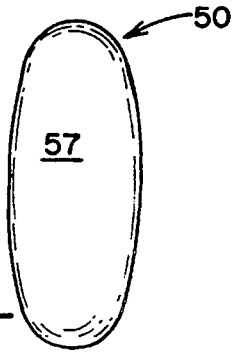
FIG. 15

CONTAINER WITH INSERT AREA

RELATED APPLICATIONS

This application is a continuation of Ser. No. 08/068,421 filed May 28,1993 now abandoned.

FEDERAL SPONSORSHIP

This invention is not made under any Federally sponsored research or development arrangement nor under any other independently sponsored research and development arrangement.

FIELD OF THE INVENTION

This invention relates generally to the art of containers such as bottles and more particularly to a container wherein at least one selected portion of the sidewall or other area is provided with an indented or recessed area such that an article, without regard to the substance of the article, may be placed therein and retained in such area with a covering film.

SHORT SUMMARY OF THE INVENTION

A container such as a bottle, of either cylindrical or rectangular or other geometric or sculptural configuration, of a plastic, formable material wherein an indentation or depressed area is provided in a sidewall thereof. The bottom of this area may be substantially flat or may be arranged at an angle to the sidewall and similarly, the sides and top of such area may be at right angles to the sidewall of the container or may be angularly arranged thereto. For example, if it is desirable to place a figurine or the like into such area, the article would best be displayed in an upright position and therefore the bottom surface would preferably be flat or adhesive elements may be provided to hold the article in upright position. Other articles may not require such consideration and therefore this indented or depressed area may take a multitude of forms. Preferably, this area would not extend entirely across the container.

After placement of the article into such area, this area will be covered with a film to retain the article therein. Obviously, dependent upon the article, the film may be clear or decorative and may take the form of a complete label around the container with a clear area being provided over the article retaining area. Similarly the bottle could be silk screened with decorative material with the film again only covering the article retaining area.

BACKGROUND AND OBJECTS OF THE INVENTION

Very often, a manufacturer of a product will wish to include a premium article along with the purchase of a product. Crudely, if the product is in a bottle, the premium is often simply taped onto the bottle. Similarly, a total product may consist of two components and the manufacturer must provide a two package arrangement. Both of these situations very often result in the loss of the premium article.

With the applicant's concept an indented or depressed area is formed in the side wall of the container such that articles, no matter what they consist of, may be placed into such area and be retained therein.

Preferrably and as the least expensive means, applicant's bottle would be blow molded, although the unit could be formed through injection molding techniques with the two halves being joined thereafter.

It is therefore an object of the applicant's invention to provide a container having an inwardly directed article receiving area extending into the same from the side wall thereof such that an article or articles may be placed and retained therein.

It is a further object of the applicant's invention to provide a container having a side wall with the side wall being provided with at least one indented or depressed area extending into the bottle having a flat bottom surface such that articles may be positioned in upright position thereon.

It is still a further object of the applicant's invention to provide a container such as a bottle of a formable plastic material wherein an indented or depressed area may be formed in the side wall of the unit during the molding process and which indentation or depression provides an article receiving area.

It is still a further object of the applicant's invention to provide a container such as a bottle wherein an indented or depressed area is provided in the side wall thereof to receive an article therein and film materials including labeling materials are utilized to retain the article within the area, the film material being adhered to the exterior surface adjacent such area.

These and other objects and advantages of the invention will more fully appear from a consideration of the description and drawings.

DESCRIPTION OF THE DRAWINGS

FIG. 6 is front view of a rectangular bottle with the indented area being illustrated on one side thereof and again illustrating such area with a covering film;

FIG. 7 is a vertical section taken substantially along Line 7—7 of FIG. 6;

FIG. 8 is a rear elevation of the bottle;

FIG. 9 is a top plan view thereof;

FIG. 10 is a bottom plan view thereof;

FIG. 11 is a front view of a sculptured form of a bottle;

FIG. 12 is a rear elevation thereof;

FIG. 13 is a vertical section taken substantially along Line 13—13 of FIG. 11;

FIG. 14 is a top plan view thereof; and,

FIG. 15 is a bottom plan view thereof.

DESCRIPTION OF PREFERRED FORMS OF THE INVENTION

Figure 1:
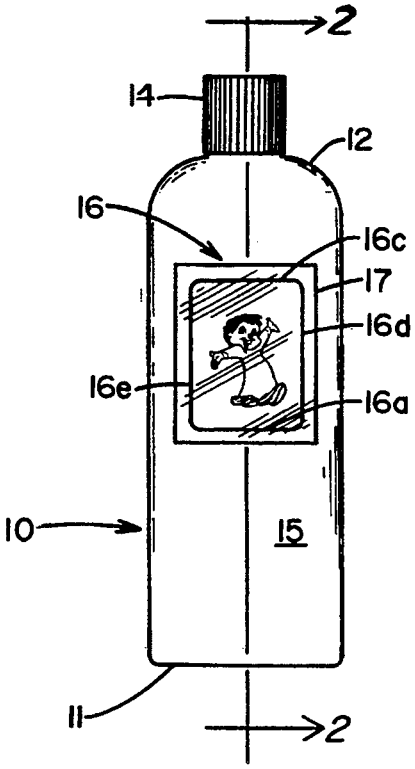
FIG. 1 is a frontal elevation of a round bottle which embodies the applicant's concept of an indented or depressed area and further illustrating the area covered by film material.
Figure 2:
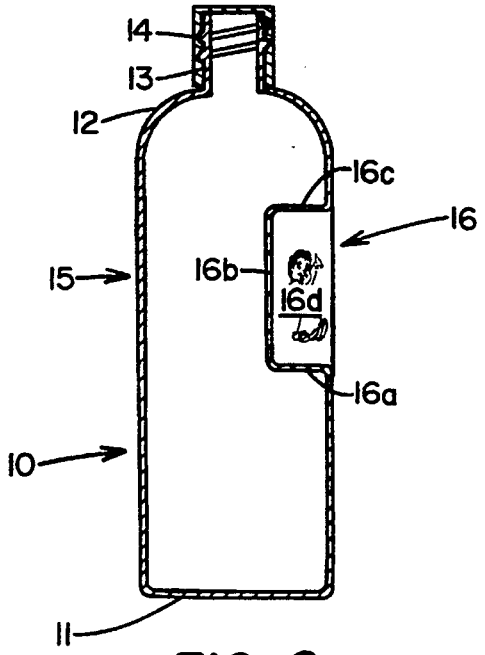
FIG. 2 is a vertical section taken substantially along Line 2—2 of FIG. 1 and illustrating the indented portion in one form.
Figure 3:
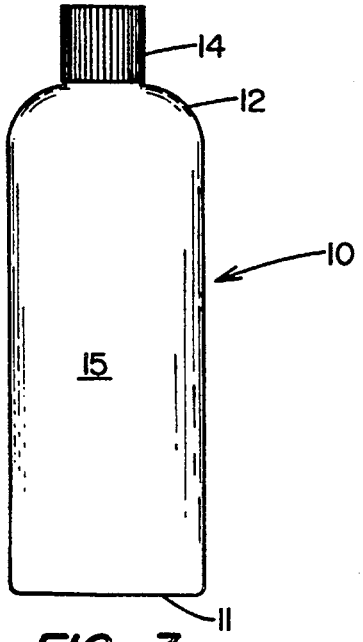
FIG. 3 is a rear elevational view of the bottle of FIG. 1.
Figure 4:
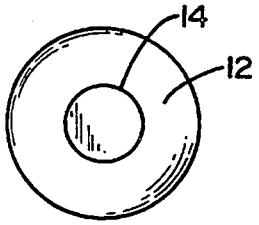
FIG. 4 is a top plan view of the bottle.
Figure 5:
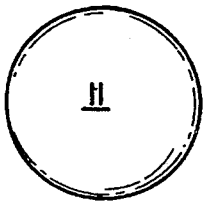
FIG. 5 is a bottom plan view of the bottle of FIG. 1.

Applicant's device is basically applicable to any type of container having generally vertical side wall sections but for the purposes and ease of illustration he has illustrated his concept on bottles of various configurations. It should be obvious that the concept could be applied to other articles such as the wide rim capped bowls or tubs which are manufactured for various useages but which also are utilized for the initial sales of various products. Therefore, the term container or bottles may appear within this application and is used as a generic definition rather than a limiting definition.

In accordance with the accompanying drawings, particularly FIGS. 1–5, a first form of the invention includes a generally cylindrical or round bottle 10 having a bottom 11, a top 12 which normally is hemispherical in shape to extend upwardly to a neck area 13 designed to receive a threaded cap 14. It should be obvious that the applicant is illustrating a typical round bottle and the specific shape thereof is modifiable without departing from the scope of the invention. For example, the hemispherical shape of the upper area 12 may be modified to many different forms. Similarly, although the applicant illustrates a round bottle, an oval or other arcuately surfaced bottle would be included in this invention.

The bottle provides a side wall 15 extending from the bottom 11 to the top. Within this side wall at least one indented or depressed area generally designated 16 is provided. Such depression would include a bottom surface 16*a*, upstanding rear surface 16*b*, a top 16*c* and side walls 16*d*, 16*e*. As illustrated in the cross section of FIG. 2, this indented area 16 has the various elements thereof arranged at substantially right angles to the side wall 15. It should be obvious that these side walls 6*d*, 16*e*, bottom 16*a* and top 16*c* could all be tapered or angularly arranged with respect to the side wall 15 without departing from the scope of the invention. Obviously with a flat and normal bottom 16*a*, a figurine or the like could be placed on said surface 16*a* and be retained in an upright position.

As illustrated in FIG. 1, a means for holding the placed article may be obtained through the use of a covering film 17 of perimetric size substantially equal to and greater than the perimetric size of the indented area 16 and the film 17 would have its edges secured to the side wall 15. This covering film could be clear or decorative without departing from the scope of the invention.

As illustrated in FIG. 1 a covering film 17 is provided and illustrated only to cover the indented area 16. Similarly the container could be silk screened or otherwise decorated with again, the only area being covered by the film being the indented area 16. The important aspect of the film situation is to provide a clear area 17 for viewing the article contained within the indented area 16.

It should be obvious that although the applicant has illustrated only one such indented area 16, that a plurality of such indented areas could be spaced on various locations of the side wall without departing from the scope of the invention.

A second form of the invention illustrating the same as applied to a rectangular bottle is provided in FIGS. 6 through 10. The bottle 30 in this case takes the form of a square with a front 31, sides 32, 33 and a back 34. A bottom 35 and top 36 are provided with the top 36 providing an illustrative cap receiving neck with the cap being designated 38. The particular shape of the bottle may be modified without departing from the scope of the invention as many forms of rectangular bottle configurations are known in the art.

As illustrated in the frontal surface 31 of FIG. 6 and the cross section of FIG. 7 an indented or depressed area 40 is provided in at least one wall of the bottle 30. This indented or depressed area includes a bottom 41*a*, top 41*b*, upstanding rear wall 41*c* and side walls 41*d*, 41*e*. The surfaces forming this indention 40 are all illustrated as being normal to the side wall 31 but these surfaces may be inwardly angularly arranged without departing from the scope of the invention. If a figurine is to be placed in the area 40 it would be preferable that the bottom surface 41*a* is flat and normal to the side wall such that the figurine would be erect.

It should be obvious that although the applicant has illustrated only one indented area that a plurality of such areas could be formed on any of these side walls or could similarly be arranged at a corner thereof.

Means to retain an article within this indented area 40 may take the form of a clear or decorative film 42 covering such area and secured as by gluing, heat sealing or the like, to the surface adjacent such area.

Applicant has illustrated the same labeling technique as discussed with the round bottle of FIGS. 1 through 5 with this rectangular bottle. The same concepts of a square bottle with the clear or decorative film arrangement is obviously available with this rectangular configuration.

Applicant has considered the aspect of a solid material being arranged within the indented areas of both bottles and it should be obvious that liquids could similarly be arranged within the indented area with means provided in the film to obtain access thereto. Such an example would be a shampoo and conditioner provision wherein the shampoo is contained within the large bottle volume and the conditioner retained in the indented area. It is immaterial to the invention what the article this area contains but it is the provision of the indented area that is of import to the invention and which appears to be unique in considering the prior art.

As illustrated in FIGS. 11–15 a sculptured or free form bottle is provided again having side surfaces 51, 52, a front and rear surface 53, 54, an upper neck area 55 to receive a cap 56 thereon and a bottom 57. As illustrated in FIG. 11, a frontal area 53*a* may be of a substantially flat configuration but again, this is a matter of choice and it must be remembered that this is a sculptured and free form shape for a bottle.

As illustrated in the cross section of FIG. 13, the indentation area is generally designated 60 and again includes a rear surface 61, top 62, bottom 63 and sides 64, 65.

The elements forming this indented area 60, as in the other descriptions, may be angularly or normally formed to the frontal surface 53 of the unit without departing from the scope of the invention.

An article retaining film 70 is positionable and placed over the indented area 60 of such container to function as the article retaining element.

This sculpture bottle again may be provided with a label over its entire surface but will perhaps lend itself to other means of decorating such as silk screening or the like.

In the various forms illustrated and described, the applicant has positioned the depressed or indented area on a vertical sidewall. It should be obvious that this depressed or indented area could be positioned on the defined bottom of the container without departing from the scope of the invention. This would be an obvious location particularly with a rectangular bottle which may be laid on its side with the bottom then being exposed to the purchaser or consumer.

Applicant has referred to the film covering the indented area in each of the forms discussed as being the primary article retaining aspect. If, for example, the article were a figurine, the figurine could be retained in such area through the use of tape or other spot type adherents with the film simply serving as a viewing area.

Many containers or bottles are formed through the blow molding process and such process would be applicable to the applicant's device in the form shown but the units could also be formed through injection molding techniques wherein individual sections of the bottle or container are molded and thereafter joined.

It should be obvious that the applicant has provided a new and unique container modification which provides the container with a dual compartment area wherein the compartments are completely separated and may be utilized for completely diverse uses. The prior art provides many bottles or containers which are internally compartmentalized with means for gaining access to any of the desired compartments but this is without the scope of the applicant's invention. With the applicant's invention free access is obtainable to the indented area without disturbing the material contained within the main body of the container or bottle.

What is claimed is:

1. A container having an insert area to receive an article therein, said container consisting of:

a. a bottom and at least one upstanding side wall to provide a hollow member to receive a first material therein;

b. said side wall converging to provide a closeable top;

c. an indentation having a perimeter formed in said side wall and directed inwardly of said hollow member to receive said article therein;

d. said indentation having substantially smooth side walls;

e. a film associated with said side wall, covering said indentation to provide a means for retaining the article within said indentation and secured on said side wall adjacent said indentation;

f. said film having a shape similar to said indentation and said film having a perimetric size substantially equal to and greater than the perimetric size of said indentation, so that the perimeter of said film is secured to said upstanding side wall; and, g. said film being clear over said indentation.

2. The container as set forth in claim 1; and, a. said indentation including bottom, top, rear and side walls;

b. said bottom, top and side walls of said indentation being arranged substantially normal to said side wall in which said indentation is formed; and, c. said rear wall of said indentation being arranged substantially parallel to said side wall in which said indentation is formed.

3. The container as set forth in claim 1; and, a. said indentation including bottom, top, rear and side walls;

b. said side walls of said indentation being arranged angularly with respect to said side wall in which said indentation is formed;

c. said top and bottom walls of said indentation being arranged substantially normally to said side wall in which said indentation is formed; and, d. said rear wall of said indentation being arranged substantially parallel to said side wall in which said indentation is formed.

4. The container as set forth in claim 1 wherein said hollow member is of a circular, cylindrical configuration thereby providing only one upstanding side wall, said inwardly directed indentation being formed in said upstanding side wall.

* * * * *